United States Patent [19]

Johnson et al.

[11] 3,955,342

[45] May 11, 1976

[54] COMPRESSION SECTION ROLLER FOR PACKAGING MACHINE

[75] Inventors: Richard H. Johnson, Arlington Heights; Wayne H. Kuhn, Worth, both of Ill.

[73] Assignee: Stone Container Corporation, Chicago, Ill.

[22] Filed: Nov. 4, 1974

[21] Appl. No.: 520,484

Related U.S. Application Data

[63] Continuation-in-part of Ser. No. 447,100, March 1, 1974, abandoned.

[52] U.S. Cl. ..... 53/387; 29/132

[51] Int. Cl.[2] ..... B65B 51/16

[58] Field of Search ..... 53/387, 388; 29/132; 193/35 R, 37; 308/215

[56] References Cited

UNITED STATES PATENTS

| | | | |
|---|---|---|---|
| 2,650,643 | 10/1953 | Fuchs | 53/388 |
| 3,139,826 | 7/1964 | Rainwater | 29/132 X |
| 3,662,446 | 5/1972 | Walls | 29/132 X |
| 3,786,549 | 1/1974 | Pott | 29/132 X |

*Primary Examiner*—Travis S. McGehee

*Attorney, Agent, or Firm*—Silverman & Cass, Ltd.

[57] ABSTRACT

A packaging machine of the type for receiving a one-piece corrugated board blank having a product or lading positioned thereon to be drawn into the machine and folded around the lading to form a completed carton which is discharged into a compression section of the machine. A plurality of vertically arranged rollers are disposed on opposite sides of the compression section to engage the side walls of the cartons while they are present in and move through the compression section. Each roller is provided with a cylindrical body over which is fitted a soft, compressible elastic sleeve of yieldable material preferably formed of foam rubber or synthetic plastic. The yieldable sleeve enables deformation thereof as a carton is pressed against each roller in the compression section to achieve a planar surface-to-surface interface or contact between each roller and the respective carton side walls as distinguished from a line-to-line surface interface where a roller is not formed of a yieldable material. Pressure is applied against the side walls of each carton as it passes through the compression section engaged against the rollers so as to hold the side wall flaps of the cartons in place while adhesive applied between the flaps and the carton walls dries and sets.

In another embodiment, a protective cover of polyethylene film is mounted over the circumference of the sleeve for additional advantages without interfering with the normal operating advantages thereof.

6 Claims, 6 Drawing Figures

FIG. 1
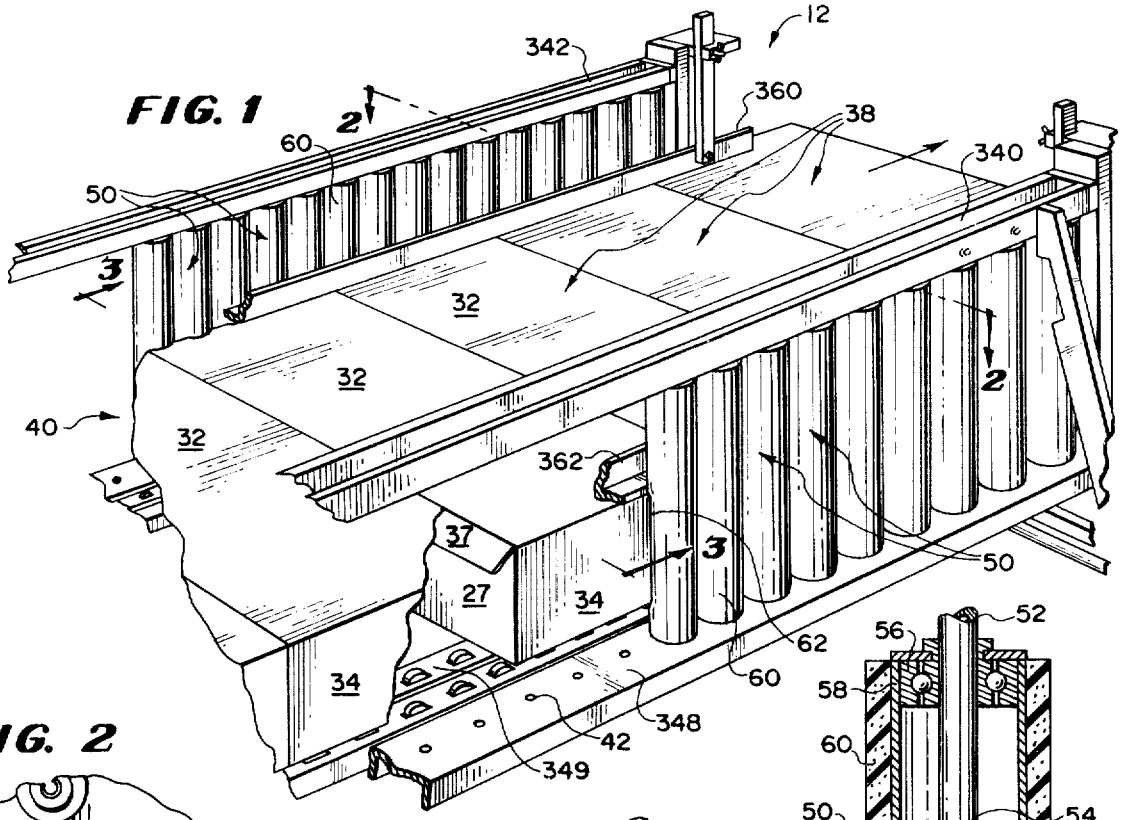
FIG. 2
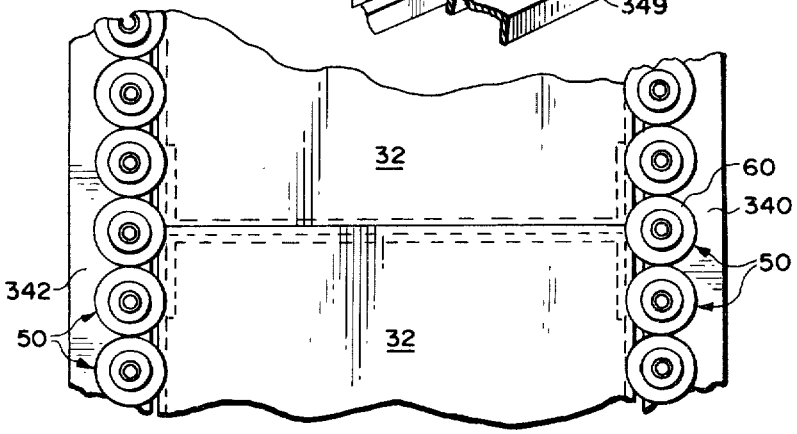
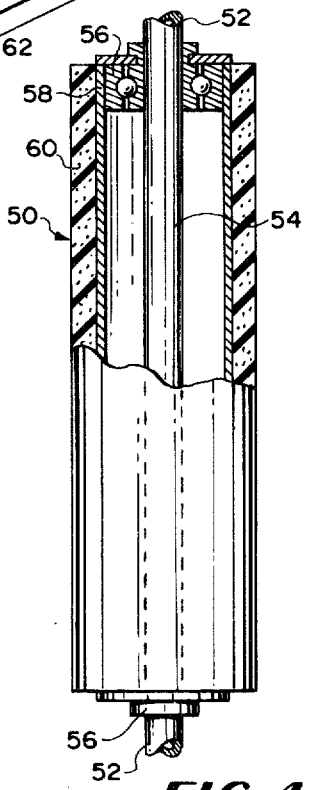
FIG. 4
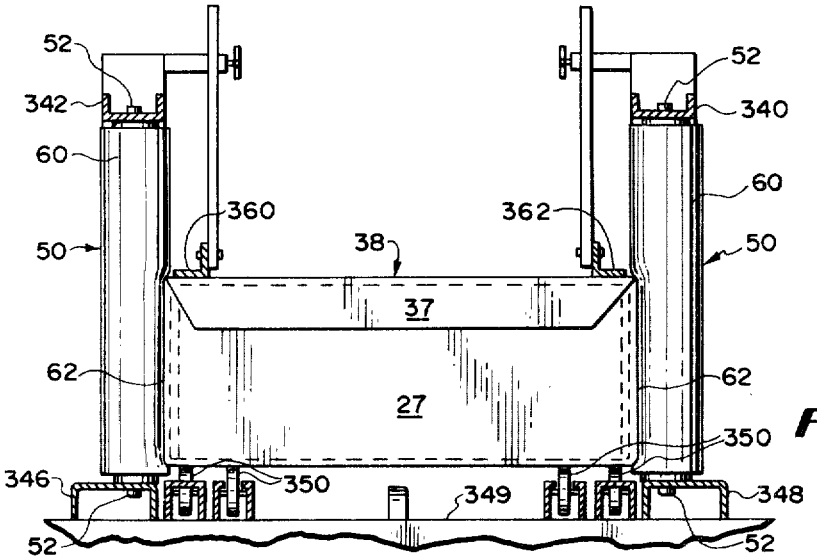
FIG 3

COMPRESSION SECTION ROLLER FOR PACKAGING MACHINE

CROSS-REFERENCE TO RELATED APPLICATIONS

This application is a continuation-in-part of application Ser. No. 447,100 filed Mar. 1, 1974, now abandoned, in the name of the same inventors as the inventors herein, and assigned to the same assignee as the present application.

The roller of the invention is particularly adapted for use in the packaging machine described in the U.S. Pat. No. 3,834,114, assigned to the same assignee as the assignee herein. The said U.S. patent will be referred to hereinafter as the "Related Patent". It is to be understood, however, that the roller of the invention may be used in the compression section of any suitable packaging machine and that, while the invention is described hereinafter in connection with the Related Patent, the description is for purposes of illustration only.

BACKGROUND OF THE INVENTION

I. Field of the Invention

This invention relates generally to the compression section or chamber of a paperboard carton packaging machine having novel compression rollers.

II. Description of the Prior Art

Packaging machines of the type for receiving a one-piece corrugated board blank having a product or lading positioned thereon to be lowered into the machine at an entrance end for formation of a carton from the blank with the lading contained therein are generally known. Such a machine is illustrated and described in the Related Patent. Suitable mechanisms are provided for folding the blank around the lading to form a completed carton which is discharged by the machine into a so-called compression section or chamber. Generally, the length of the compression section is sufficient to receive a plurality of packages from the machine.

During operation of the packaging machine, the compression section thereof is filled with completed cartons arranged in a row. Then, as a next completed carton is pushed into the compression section, it pushes the row of cartons ahead of it and discharges a carton from the discharge end of the machine. During continued operation of the machine, a completed carton fed into the compression section causes one such carton to be discharged from the end of the section. Consequently, the completed carton initially fed into the compression section remains in the section for a certain period of time as it is intermittently pushed along the compression section to the discharge end thereof. This time period in the compression section is required to permit adhesive applied to the flaps of the carton blank while in the packaging machine to dry and set.

In order to achieve proper setting or drying of the adhesive, the cartons in the compression section must be maintained square and in true abutting alignment so that all flaps will remain in proper registry with carton panels during the drying or setting time period. Concurrently, the cartons must be moved along the compression section during the drying period.

In order to achieve the required maintainence of the cartons in true abutting alignment during setting of the adhesive while the carton is in the compression section, the vertical sides of the compression section of prior structures, including that disclosed in the Related Patent, were constructed with parallel rows of vertically arranged rollers formed of a non-yieldable material such as wood or metal. A continuous non-yieldable flat belt or web of rubber, canvas or felt material was trained or positioned around each row of rollers to abut the side walls of the carton as they passed through the compression section of the packaging machine. The non-yieldable belt was such as to produce a line-to-surface interface between the respective carton side walls and the belt by adjusting the distance between the belts to be slightly less than the width of each carton. Such interface has an inherent disadvantage in that cartons may become undesirably compressed or deformed as they move through the compression section. It is necessary for tolerances of the compression section to be variable to accommodate various size cartons which may be formed by the packaging machine. In operation of the prior art structures, the operator of the machine was required to exercise considerable care to be sure that the compression section side walls having the continuous non-yieldable belt were positioned precisely so as on the one hand to maintain the cartons in proper registry while they are in the compression section, and on the other hand, to avoid moving the walls so closely together in an effort to achieve the required restraining of the cartons that the walls thereof were too tightly compressed thereby resulting in damage thereto.

The rollers of the invention provide the required solution to the problems encountered with the non-yieldable rollers and belt utilized in the compression section of the Related Patent. The rollers of the invention are formed with yieldable sleeves such that the belt no longer is required and the rollers themselves form the side walls of the compression section. Further, the yieldable sleeves formed on the outer surface of the rollers of the invention are such that as a carton is pressed against them in the compression section, a planar, surface-to-surface interface or contact between the rollers and the side walls of each respective carton is achieved. The rollers of the invention are such as to properly maintain the cartons passing through the compression section of the packaging machine in square and true abutting alignment as required and additionally, by reason of the soft compressible material on the rollers, adjustments to vary the distance between the walls of the compression section may be made without the danger of moving the walls too closely together which might damage the cartons as they pass through the chamber, as was the case with the prior art structures.

In order to protect the yieldable sleeves of the rollers of the invention from excessive wear which distorts the same and further, to produce a reduced friction, and less adherent surface between the rollers and carton side walls, the sleeves may be covered with protective polyethylene film. The addition of the film does not interfere with the intended performance of the rollers of the invention.

SUMMARY OF THE INVENTION

The invention is characterized by a roller provided with a cylindrical body over which is fitted a soft, compressible, elastic sleeve constructed of a foam rubber or synthetic plastic material. The soft, compressible material enables deformation of the sleeve as a carton is pressed against it in the compression section of a packaging machine so as to achieve the planar surface-to-surface interface or contact between the roller and the side walls of the carton to maintain the carton square and in true abutting alignment with a next adjacent carton in the compression section so that all flaps will remain in proper registry with carton panels during drying or setting of adhesive applied therebetween. A protective cover of polyethylene film may be secured over the elastic sleeve to protect the same from wear and to produce a reduced friction and less adherent interface between the roller and carton walls.

BRIEF DESCRIPTION OF THE DRAWINGS

FIG. 1 is a fragmentary perspective view of the compression chamber of a packaging machine such as that described in the Related Patent, with the rollers of the invention positioned thereon;

FIG. 2 is a fragmentary sectional view taken along the line 2—2 of FIG. 1 in the direction indicated generally;

FIG. 3 is a sectional view taken along the line 3—3 of FIG. 1 in the direction indicated generally;

FIG. 4 is a fragmentary plan view of the roller of the invention with a portion thereof broken away to show constructional details;

DESCRIPTION OF THE PREFERRED EMBODIMENTS

Figure 5:
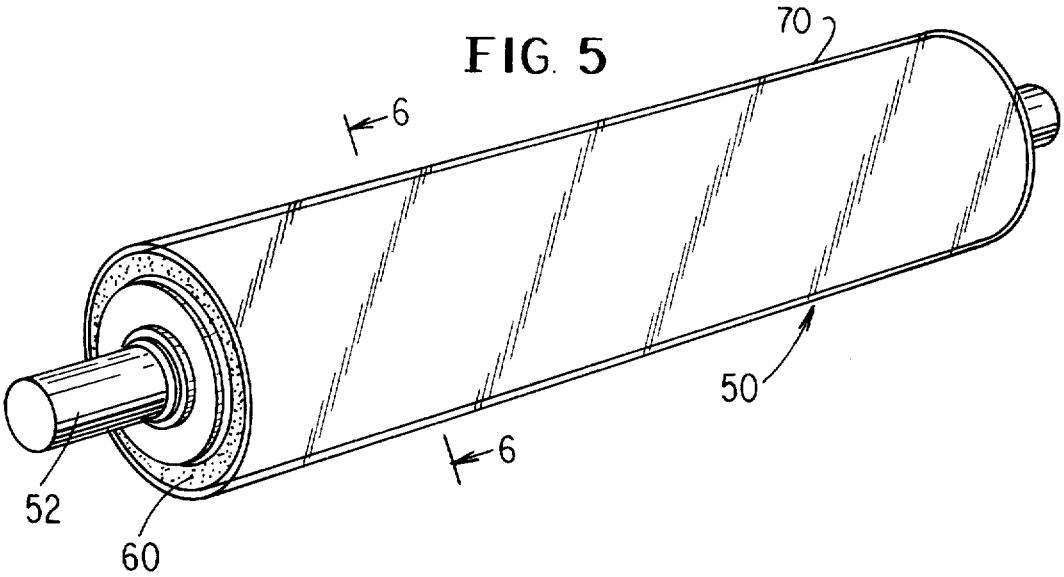
FIG. 5 is a perspective view of an alternate embodiment of the roller shown in FIG. 4 with a protective cover secured thereon.

The invention is particularly adapted for use in the so-called compression section or chamber of a packaging machine of the type described in the Related Patent. For this reason, the drawing illustrates portions of the Related Patent which are relevant to a description of the roller of the invention. For convenience, the elements and parts of the Related Patent which are illustrated in the drawing herein are identified by the same reference numerals as those given in the specification of the Related Patent. No intent is made thereby to limit the invention herein to use in any specific packaging machine but rather, it is intended that the roller of the invention may be used in any machine which includes an elongate linear compression section.

In FIG. 1, the exit end 12 of a packaging machine having a compression section or chamber 40 is shown with a plurality of packages 38 positioned therein. The packages 38 are formed from blanks having at least top and bottom wall panels, front and rear end wall panels and side flaps. In the drawing, only top panel 32, side flap 34, front end wall panel 27 and end flap 37 is visible. Reference is made to the Related Patent for a more complete description of the package 38.

The compression chamber 40 includes upper side frames 340, 342 and lower side frame 346, 348. There is a bottom wall 349 mounting a plurality of idler rollers 350 which facilitate travel of the packages 38 through the chamber 40. A pair of adjustable guide bars 360, 362 are mounted on the compression chamber to guide the upper portions of the packages as they pass through the compression chamber.

Packages 38 enter the compression chamber 40 of the packaging machine from a package completion station (not shown) which would be positioned to the left of chamber 40 as viewed in FIG. 1. As a package 38 is moved into the compression chamber 40, the front end wall panel of the package engages against the folded end flap 37 of the completed package 38 thereby maintaining pressure on the end flap 37 while adhesive applied between the end flap 37 and the rear end wall 27 dries and sets. The package 38 then continually moves through the compression chamber 40 toward the exit end 12 thereof until it finally is pushed out of the packaging machine at the exit end as described in the Related Patent.

The vertical side walls of the compression chamber 40 are required to be of a construction which will apply pressure to the side flaps 34 of packages 38 while they are in the compression chamber, so as to impede movement of the completed packages 38 as they move within the chamber. Movement of each package 38 must be impeded so that succeeding packages will press against end flaps 37 of the preceding packages and thereby hold the end flaps 37 in place while adhesive is setting. Additionally, the side walls of the compression chamber function to maintain each package 38 square and in true abutting alignment so that all flaps will remain in proper registry with carton panels during the drying or setting time period. These operations are accomplished by reason of the rollers 50 of the invention which form the side walls of the compression chamber 40 and are constructed as described below.

The side walls of the compression chamber 40 are formed by a plurality of rollers 50 disposed in abutting relationship between frame members 340, 348 and 342, 346 respectively. A plurality of apertures 42 is provided in each of the frame members to receive the extending portions 52 of an axis rod 54 which passes through each roller 50. Each roller 50 is of identical construction and therefore only one such roller will be described in detail.

The roller 50 includes a central axis or shaft 54 having positioned at opposite ends thereof a respective bushing member 56. The bushing 56 retains cylindrical body portion 58 upon shaft 52 such that the body portion is freely rotatable about the shaft. Cylindrical body 58 is fitted along the entire elongate length thereof with a soft, compressible, elastic sleeve 60 which is formed preferably from a foam rubber synthetic plastic material. The sleeve 60 is resilient so that it will assume its undeformed configuration as shown in FIG. 4 when no pressure is exerted upon the roller 50.

In operation, the side walls of compression chamber 40, which are adjustable for movement towards or away from each other, would be moved by the machine operator such that the distance between the side walls is slightly less than the width of each completed package or carton 38. As each package 38 enters the compression chamber 40, the side flaps 34 engage the rollers 50 to deform the yieldable sleeve 60 as indicated at reference number 62 in FIGS. 1 and 3. The portions of sleeve 50 which are not engaged by carton 38 remain in their undeformed condition. By reason of the yielding of the sleeve 60 along the portions 62 thereof, a planar surface-to-surface interface or contact is achieved between each roller 50 and the side flaps 34 as the cartons 38 pass through the compression chamber 40.

The vertically arranged compressible rollers 50 with yieldable sleeves 60 provide rigidity to each carton 38 as it passes through the compression chamber 40 and also provide cushioning for desired pressure maintainence on the end closing flaps 37, 34 of the cartons 38. The rollers 50 permit the necessary compression against the cartons 38 without distorting the packages.

The sleeves 60, being constructed of foam rubber or other synthetic plastic material, are subject to significant wear due to abrasive action between the sleeves and the carton walls as the cartons move through the compression section. Adhesive applied to the carton flaps tends to be squeezed out and a small amount is transferred to the sleeves; this excess adhesive must be cleaned periodically from the sleeves, but since they are soft foam rubber material, the cleaning thereof is difficult. Further, in some instances the foam rubber material of the sleeves produces too high a coefficient of friction with the carton walls with which contact is made and it is desired to reduce the coefficient of friction without reducing the desired yieldable characteristics of the sleeves.

Figure 6:
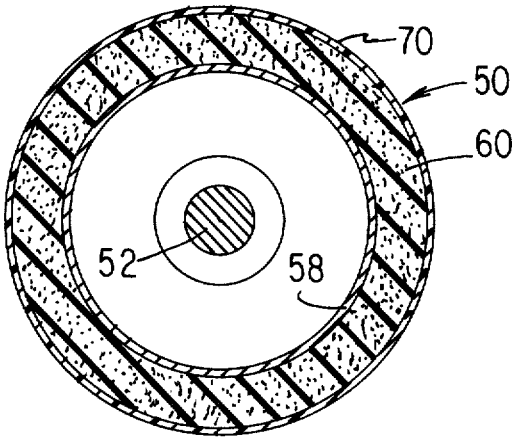
FIG. 6 is a sectional view taken along the line 6—6 of FIG. 5 in the direction indicated generally.

In order to render the sleeves 60 more wear-resistant, easier to clean and having reduced coefficient of friction characteristics, a protective cover 70 is secured over sleeve 60 as shown in FIGS. 5 and 6. The cover 70 is plastic or polyethylene film, but any other suitable protective cover material may be used. Plastic cover 70 is easily cleaned, protects the soft foam sleeve 60 from excessive wear, and produces a coefficient of friction with carton walls 34 significantly less than that of the foam material. Addition of the film 70 over the sleeve 60 does not interfere with the performance of the soft sponge material but does make clean-up of the adhesive from the rollers much simpler and increases the life of the foam rubber.

Although not illustrated specifically, it is contemplated that the rollers 50 can be gang operated by suitable chains or belt arrangements well-known in the art so that the rollers move in unison. Such roller movement in unison helps keep the cartons in the compression chamber close together and contact between adjacent cartons as they move through said compression chamber. Further, in order to prevent backward movement of the cartons in the compression chamber, the first several rollers 50 at the entrance end of the compression chamber can be provided with one-way bearings to limit their movement in an angular direction into the chamber.

What is claimed and desired to secure by Letters Patent of the United States is:

1. In a packaging machine which is operable to fold a blank into a carton about an article or articles to be packaged, the carton having at least an end flap and wall and side flaps and walls, the packaging machine including a blank folding station, a flap folding station, and a package completion station with a compression chamber into which partially completed cartons are moved, the improvement comprising, said compression chamber having side walls formed of a plurality of vertically arranged cylindrical rollers, each roller including a rigid cylindrical body portion rotatably mounted on a shaft, an elastic deformable sleeve of soft compressible material formed on the external surface of the body portion, and a yieldable protective soft thin film cover secured over the entire circumferential surface of the sleeve, whereby the rollers engage the carton and form a resilient planar surface-to-surface interface between the carton walls and the deformed roller to maintain the folded side flaps thereof under pressure in rigid condition for sealing of said side flaps, and the rollers partially inhibit the movement of the cartons through the compression chamber, the sleeve of each roller being resilient so as to regain its undeformed condition after the carton passes out of contact therewith.

2. The invention as claimed in claim 1 in which the sleeve of each roller is formed of foam rubber material.

3. The invention as claimed in claim 1 in which the cover is formed of polyethylene film material.

4. The packaging machine as claimed in claim 1 in which the side walls are adjustably moveable for closer or farther apart spacing thereby to enable the compression chamber to accommodate cartons of different widths.

5. The packaging machine as claimed in claim 1 in which said rollers are rotated in unison as the cartons are moved through the compression chamber.

6. The packaging machine as claimed in claim 1 in which several of the rollers at the entrance end of the compression chamber into which cartons are moved are mounted in one-way bearings so as to limit their direction of movement forwardly into the compression chamber.

* * * * *